United States Patent [19]

Aoi et al.

[11] Patent Number: 4,593,657

[45] Date of Patent: Jun. 10, 1986

[54] CAMSHAFT BEARING ARRANGEMENT

[75] Inventors: Kazuo Aoi; Toshikazu Ozawa, both of Hamamatsu, Japan

[73] Assignee: Yamaha Hatsudoki Kabushiki Kaisha, Japan

[21] Appl. No.: 743,600

[22] Filed: Jun. 11, 1985

[30] Foreign Application Priority Data

Jun. 12, 1984 [JP] Japan ..... 59-119184

[51] Int. Cl.[4] ..... F01L 1/04

[52] U.S. Cl. ..... 123/90.6; 123/90.27; 123/193 H

[58] Field of Search ..... 123/90.6, 90.27, 193 H

[56] References Cited

U.S. PATENT DOCUMENTS

| | | | |
|---|---|---|---|
| 3,289,658 | 12/1966 | Suroveh, Sr. | 123/90.6 |
| 4,430,968 | 2/1984 | Futakuchi et al. | 123/193 H |
| 4,534,325 | 8/1985 | Tanaka | 123/90.6 |

FOREIGN PATENT DOCUMENTS

| | | | |
|---|---|---|---|
| 98180 | 1/1984 | European Pat. Off. | 123/90.27 |
| 150010 | 9/1983 | Japan | 123/90.27 |
| 204904 | 11/1983 | Japan | 123/90.6 |

*Primary Examiner*—Ira S. Lazarus

*Attorney, Agent, or Firm*—Ernest A. Beutler

[57] ABSTRACT

An internal combustion engine of the multiple valve type embodying an improved supporting arrangement for a camshaft that directly operates one valve and indirectly operates a pair of valves. The camshaft is provided with bearing surfaces on opposite sides of the cam lobes and a pair of bearing caps cooperate with the cylinder head for supporting these bearing surfaces. Each bearing cap and the cylinder head journal one of the bearing surfaces of the camshaft around its circumference and the other of the camshaft bearing surfaces are journaled only by the bearing cap and not by the cylinder head so as to afford clearance and yet adequate support.

10 Claims, 6 Drawing Figures

CAMSHAFT BEARING ARRANGEMENT

BACKGROUND OF THE INVENTION

This invention relates to a camshaft bearing arrangement for an internal combustion engine and more particularly to an improved arrangement for journaling a camshaft for rotation.

Many internal combustion engines employ overhead camshafts for operating their valves. The valves may be operated either directly from the cam lobes by means such as thimble tappets or may be operated independently by rocker arms. Alternatively, the single camshaft may be employed for both direct and indirect valve actuation. Normally, it is the practice to provide a plurality of cam lobes on a given camshaft with bearing surfaces being interposed between the respective cam lobes. It is important to rigidly journal the camshaft so as to avoid deflection and resulting inefficient valve operation. However, where the camshaft is employed to operate rocker arms, it is the normal practice to expose portions of the camshaft so as to clear the rocker arms. Also, where there are a large number of cam lobes, it is very difficult with conventional arrangements to provide the adequate support for the camshaft and at the same time the necessary clearances.

It is, therefore, a principal object of this invention to provide an improved camshaft bearing arrangement for internal combustion engines.

It is a further object of this invention to provide a camshaft bearing arrangement wherein the camshaft is rigidly supported and yet adequate clearances are achieved.

SUMMARY OF THE INVENTION

A first feature of this invention is adapted to be employed in a bearing arrangement for the camshaft of an internal combustion engine or the like which camshaft is formed along its length in axial order with a first bearing surface, a first cam lobe, a second bearing surface, a second cam lobe, a third bearing surface, a third cam lobe and a fourth bearing surface. In accordance with the invention, first bearing means extend around substantially the full circumference of the first bearing surface and journal the first bearing surface. Second bearing means extend around substantially less than the circumference of the second bearing surface and journal the second bearing surface. Third bearing means extend around substantially less than the circumference of the third bearing surface and journal the third bearing surface and fourth bearing means extend around substantially the full circumference of the fourth bearing surface and journal the fourth bearing surface.

A further feature of the invention is adapted to be embodied in a bearing arrangement for a camshaft having a cam lobe and bearing surfaces on the opposite sides of the cam lobe. A bearing cap has axially spaced first and second bearing surfaces that cooperate respectively with the camshaft bearing surfaces. First bolting means are formed by the bearing cap on opposite sides of its first bearing surface for passing fastening means adapted to affix the bearing cap to an associated component of the engine. Second bolting means is formed on only one side of the second bearing surface for passing a single fastening means to affix the bearing cap to the associated engine component.

DETAILED DESCRIPTION OF THE PREFERRED EMBODIMENT

Figure 1:
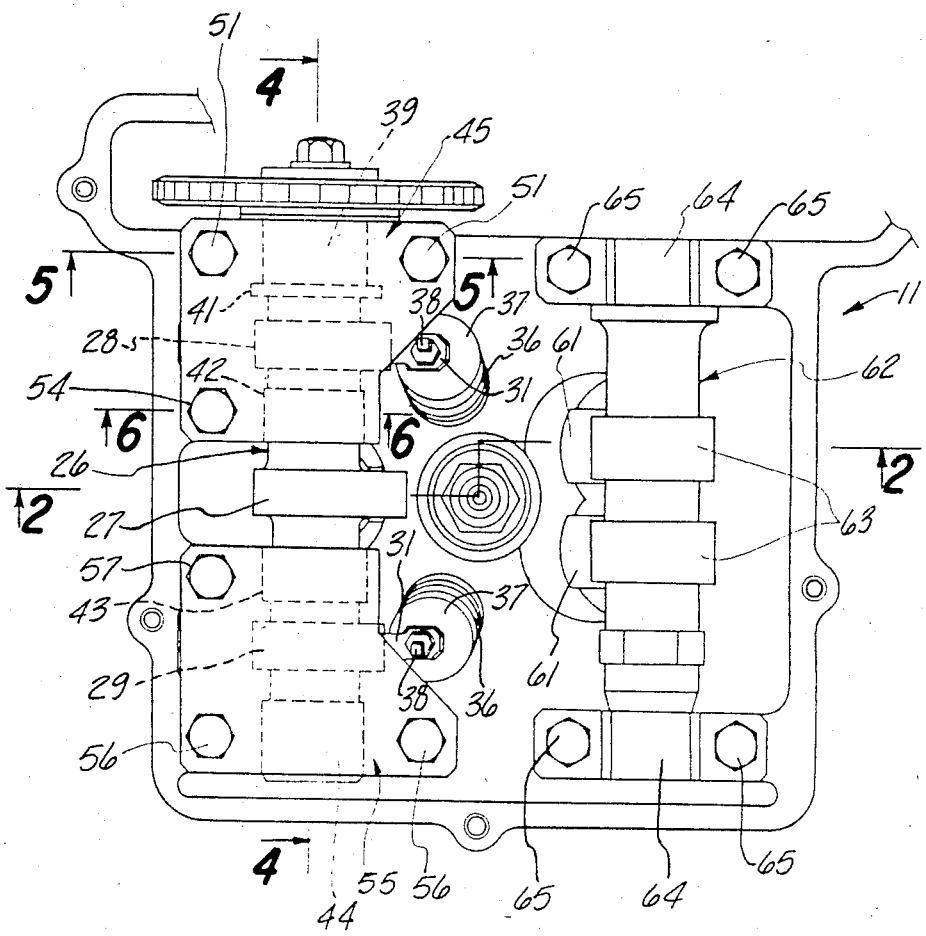
FIG. 1 is a top plan view of a portion of an internal combustion engine constructed in accordance with an embodiment of the invention with parts removed and portions broken away and is taken generally in the direction of the arrow 1 in FIG. 2.

An internal combustion engine constructed in accordance with an embodiment of the invention is identified generally by the reference numeral 11. Inasmuch as the invention is directed toward the supporting arrangement for one of the camshafts of the engine 11, only the cylinder head and upper portion of the cylinder block have been illustrated and components such as the cam cover have been removed so as to more clearly show the camshaft mounting arrangement.

The engine 11 includes a cylinder block 12 having a cylinder bore 13 in which a piston (not shown) is supported for reciprocation in a known manner and which drives a crankshaft in a known manner. The portions of the engine not illustrated may be considered to be conventional in construction.

A cylinder head assembly, indicated generally by the reference numeral 14, is affixed to the cylinder block 12 in an appropriate manner. The cylinder head assembly 14 is provided with a cavity or recess 15 that cooperates with the cylinder bore 13 and head of the piston so as to form a chamber of variable volume, which chamber is oftentimes referred to as the combustion chamber. Although the invention is described in conjunction with a single cylinder, it is to be understood that it may be practiced with engines of the multiple cylinder type and engines having any of the known types of cylinder configuration such as inline, V-type, etc.

Three intake valves 16 are provided in the cylinder head assembly 14 for the combustion chamber 15. The intake valves 16 have respective valve stems 17 that are supported for reciprocation within respective valve-guides 18 that are pressed into the cylinder head assembly 12. One or more intake passages 19 extend through the cylinder head assembly 14 and terminate at individual ports and valve seats with which the heads of the intake valves 16 cooperate so as to control the flow of a charge into the chamber 15 through the intake passages 19. The intake valves 16 are all grouped on substantially one side of a vertically extending plane containing the axis of the cylinder bore 13.

A pair of exhaust valves 21 are also supported in the cylinder head assembly 14 by having their valve stems 22 slidably supported within valve guides 23 pressed into the cylinder head 14. The exhaust valves 21 control the communication of the chamber 15 with exhaust passages 24 formed in the cylinder head 14 on the side of the aforedescribed plane opposite to the intake passages 19. The heads of the intake valves 21 also lie on the opposite side of this plane.

A spark plug opening 25 is formed in the cylinder head 14 centrally of the cylinder bore 13 and chamber 15. A spark plug (not shown) is positioned in the opening 25 with its gap in the chamber 15 for firing the charge therein.

The placement of the intake valve 16 and exhaust valves 21 is particularly important in providing a combustion chamber of small clearance volume and yet one in which the multiple valves may be free to open and close without interference. Reference may be had to copending Applications Ser. No. 369,665, field Apr. 19, 1982, entitled "Four-Cycle Engine", and Ser. No. 717,832, filed Mar. 29, 1985, entitled "Actuating Mechanism For Multiple Valve Internal Combustion Engine", and assigned to the assignee of this application, for the specific valve placement. Inasmuch as this invention is directed toward the supporting arrangement for the camshaft, further discussion of the valve placement is not believed to be necessary to understand this invention.

An intake.camshaft, indicated generally by the reference numeral 26, is supported in the cylinder head assembly 14 for rotation about an axis that lies on the same side of the aforedescribed plane as the intake valves 16. A camshaft 26 is journaled in a manner to be described and has a first or central lobe 27 that directly operates the centermost of the intake valve 16 and outer lobes 28 and 29 that indirectly operate the remaining intake valves by means of rocker arms 31 that are suitably journaled on the cylinder head assembly 14.

Figure 2:
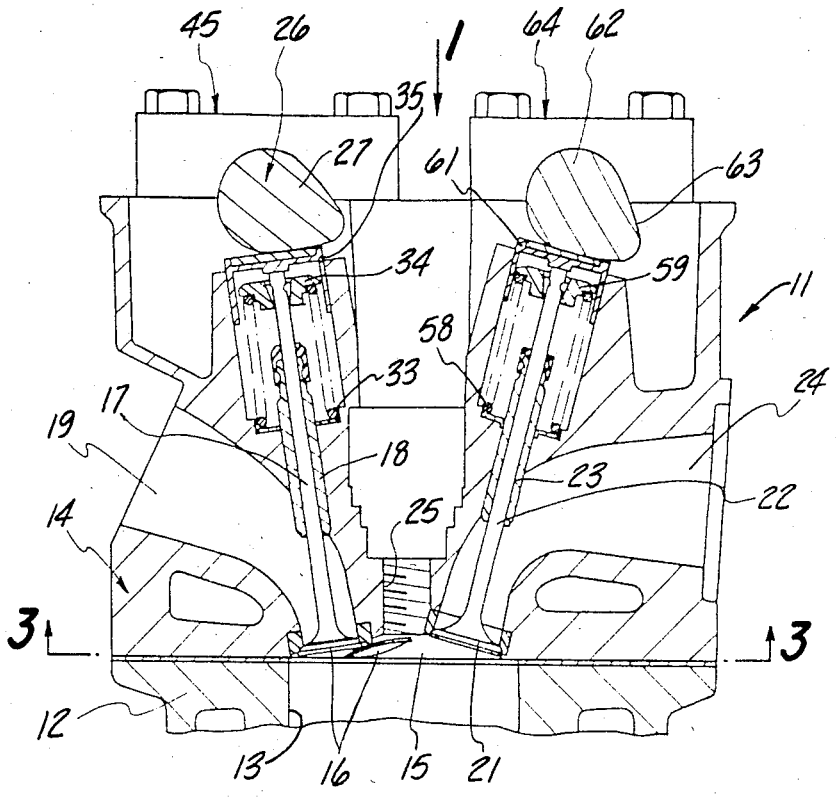
FIG. 2 is a cross-sectional view taken along the line 2—2 of FIG. 1.
Figure 3:
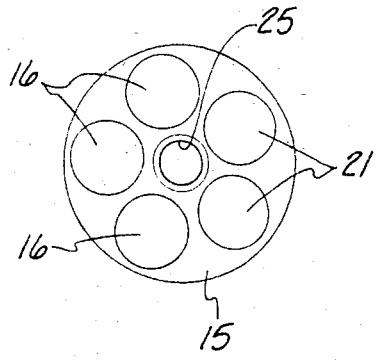
FIG. 3 is a cross-sectional view taken along the line 3—3 of FIG. 2 and shows the valve placement within the combustion chamber.
Figure 4:
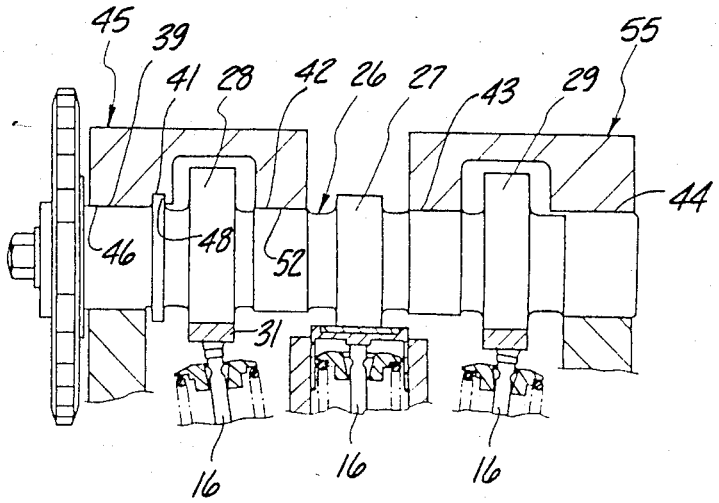
FIG. 4 is a cross-sectional view taken along the line 4—4 of FIG. 1.
Figure 5:
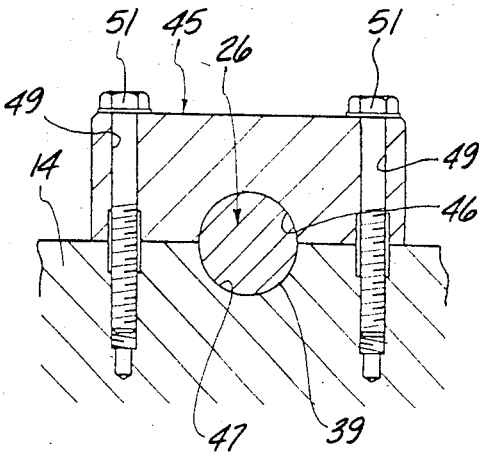
FIG. 5 is a cross-sectional view taken along the line 5—5 of FIG. 1.

Referring to FIG. 2, the centermost intake valve has its stem 17 surrounded by a coil compression spring 33 that acts against a keeper retainer assembly 34 so as to urge this intake valve toward its closed position. A thimble tappet 35 is slidably supported in the cylinder head assembly 14 and is engaged with the cam lobe 27 so as to effect direct actuation of this intake valve via the thimble tappet 35.

Coil springs 36 encircle the stems 17 of the remaining intake valves 16 and operate against keeper retainers 37 so as to urge these remaining intake valves toward their closed positions. The outer ends of the rocker arms 31 carry adjusting screws 38 that cooperate with the tips of these valves for actuating them.

A camshaft 26 is provided with a first bearing surface 39 on one side of the cam lobe 28. A thrust surface 41 may be formed on the camshaft 26 immediately adjacent the bearing surface 39. A second bearing surface 42 is formed on the camshaft 26 on the opposite side of the cam lobe 28 and between the cam lobes 27 and 28. A third bearing surface 43 is positioned on the opposite side of the cam lobe 27 and between the cam lobes 27 and 29. A fourth bearing surface 44 is formed on the opposite side of the cam lobe 29. The bearing surfaces 39, 42, 43 and 44 are journaled in a manner now to be described.

A first bearing cap, indicated generally by the reference numeral 45, is affixed to the cylinder head 14 in a manner to be described and cooperates with the camshaft bearing surfaces 39 and 42 for journaling them. The first bearing cap 45 has a first bearing surface 46 that engages and supports the upper half of the camshaft bearing surface 39. The cylinder head 14 is provided with a corresponding bearing surface 47 which, with the bearing cap bearing surface 46, engages the camshaft bearing surface 39 substantially around its circumference. In addition, a thrust bearing surface 48 may be formed in the bearing cap 45 for providing thrust bearing and thrust location of the camshaft 26. It should be noted that the portion of the bearing cap 45 defining the surface 46 extends for a substantial distance on both sides of the camshaft 26 and is provided with a pair of bored openings 49 each of which is adapted to receive a threaded fastener such as a bolt 51 for affixing this end of the bearing cap 45 to the cylinder head assembly 14 on opposite sides of the camshaft bearing surface 39.

Figure 6:
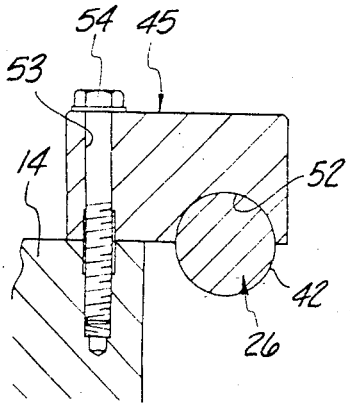
FIG. 6 is a cross-sectional view taken along the line 6—6 of FIG. 1.

At a point spaced axially from the bearing surface 46, the bearing cap 45, is provided with a further bearing surface 52 that is engaged with the camshaft bearing surface 42. As may be seen from FIG. 6, the bearing surface 52 of the cap 45 extends through approximately 180° for engaging the camshaft bearing surface 42 through this extent. However, in this area, the cylinder head 14 is provided with no corresponding bearing surface that engages the camshaft bearing surface 42 so it is only borne by means of the bearing cap bearing surface 52. It should be noted that the bearing surface 52 is disposed in opposition to the action of the valve springs 36 and 33 and thus bears their load. There are no substantial loads acting in the opposite direction on the camshaft 26 so that this bearing arrangement will be satisfactory and, furthermore, will provide adequate clearance to clear the rocker arm 31 and avoid any interference with the rocker arms and/or the thimble tappets 35.

Adjacent the bearing surface 52, the bearing cap 45 is provided with a bore 53 to pass a single threaded fastener 54 that secures this portion of the bearing cap 45 to the cylinder head 14. As may be clear from FIGS. 1 and 6, the bearing cap has a truncated or cutoff shape so as to afford access to the adjusting screw 38 and the valve actuated by the cam lobe 28.

A further bearing cap, indicated generally by the reference numeral 55 is provided for journaling the camshaft bearing surfaces 43 and 44. Like the bearing cap 45, the bearing cap 55 has a first surface that cooperates with approximately one-half of the camshaft bearing surface 44 and which cooperates with a corresponding bearing surface formed in the cylinder head assembly 12 so as to support the camshaft bearing surface 44 around its entire circumference. This end of the bearing cap 55 is formed with bored openings that pass a pair of threaded fasteners 56 for affixing the bearing cap 55 to the cylinder head assembly 12. The bearing surface 43 is journaled by a single bearing surface formed on the bearing cap 55 with no corresponding bearing surface on the cylinder head 12 as with the bearing cap bearing surface 52 and its cooperation with the camshaft bearing surface 42. A single threaded fastener 57 formed on only one side of the bearing cap 55 affixes the bearing cap to the engine and the bearing cap 55 is truncated like the bearing cap 45 so as to afford access to the rocker arm 31 and adjusting screw 38.

Referring now to the actuation of the exhaust valves 21, they are provided with coil compression springs 58 that encircle their respective stems 22 and which engage keeper retainer assemblies 59 so that the valves 21 are urged toward their closed position. The valves 21 are operated directly by means of thimble tappets 61 that are slidably supported in suitably formed openings formed in the cylinder head assembly 14. An exhaust camshaft 62 is provided with respective lobes 63 that engage each of the thimble tappets 61 so as to directly actuate the exhaust valves 21. The exhaust camshaft 62 is journaled in the cylinder head assembly 14 by means of spaced bearing caps 64 that are affixed to the cylinder head assembly by means of fasteners 65 in a conventional manner. It is to be understood, however, that if three exhaust valves are employed per cylinder, that the exhaust camshaft 62 may be supported in the same manner as the intake camshaft 26.

The camshafts 26 and 62 are driven in timed sequence with the engine crankshaft in any known manner.

It should be readily apparent from the foregoing description that the supporting arrangement for the intake camshaft provides an extremely rigid support for it and yet affords clearance for the rocker arm adjusting screws and other components of the engine.

Although an embodiment of the invention has been illustrated and described, various changes and modifications may be made without departing from the spirit and scope of the invention, as defined by the appended claims.

We claim:

1. A bearing arrangement for the camshaft of an internal combustion engine or the like which camshaft is formed along its length in axial order with a first bearing surface, a first cam lobe, a second bearing surface, a second cam lobe, a third bearing surface, a third cam lobe and a fourth bearing surface, the improvement comprising first bearing means extending around substantially the full circumference of said first bearing surface and journaling said first bearing surface, second bearing means extending around substantially less than the circumference of said second bearing surface and journaling said second bearing surface, third bearing means extending around substantially less than the circumference of said third bearing surface and journaling said third bearing surface, and fourth bearing means extending around substantially the full circumference of said fourth bearing surface and journalling said first bearing surface.

2. A bearing arrangement as set forth in claim 1 wherein the second and third bearing means extend around the portion of the circumference of the camshaft disposed in opposition to the direction of valve actuation.

3. A bearing arrangement as set forth in claim 2 wherein the second and third bearing means extend through aproximately 180° of the circumference of the respective camshaft bearing surfaces.

4. A bearing arrangement as set forth in claim 1 wherein the first and second bearing means are formed in part by a first bearing cap and the third and fourth bearing means are formed at least in part by a second bearing cap.

5. A bearing arrangement as set forth in claim 4 wherein the first bearing means is formed by the first bearing cap and an associated cylinder head to which the bearing cap is affixed and the fourth bearing means is formed by the second bearing cap and the cylinder head.

6. A bearing arrangement as set forth in claim 5 wherein the bearing caps are affixed to the cylinder heads by means of a first pair of threaded fasteners extending through the bearing caps on opposite sides of their respective first and fourth bearing means and a pair of single second threaded fasteners each extending through the respective bearing cap on one side of their respective second and third bearing means.

7. A bearing arrangement as set forth in claim 5 wherein the cylinder head reciprocally supports first, second and third valves, the second cam lobe being effective to directly operate the second valve and the first and third cam lobes being effective to indirectly operate the first and third valves through rocker arms.

8. A bearing arrangement as set forth in claim 7 wherein the bearing caps are affixed to the cylinder head by means of a first pair of threaded fasteners extending through the bearing caps on opposite sides of their respective first and forth bearing means and a pair of single second threaded fasteners each extending through the respective bearing cap on one side of their respective second and third bearing means.

9. A bearing arrangement for a camshaft having a cam lobe and bearing surfaces on opposite sides of said cam lobe comprising a bearing cap having axially spaced first and second bearing surfaces cooperating respectively with the camshaft bearing surfaces, first bolting means formed by said bearing cap on opposite sides of said first bearing surface for passing a pair of fastening means adapted to affix said bearing cap to an associated component of the engine, and second bolting means formed on only one side of said second bearing surface of said bearing cap for passing a single fastening means for affixing said bearing cap to the associated engine component.

10. A bearing arrangement as set forth in claim 9 wherein the bolting means comprise bored openings formed in the bearing cap.

* * * * *